US008975992B2

(12) United States Patent
Böttcher et al.

(10) Patent No.: US 8,975,992 B2
(45) Date of Patent: Mar. 10, 2015

(54) ELECTROMAGNETIC DRIVE

(75) Inventors: Martin Böttcher, Berlin (DE); Marcus Kampf, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/342,833

(22) PCT Filed: Aug. 23, 2012

(86) PCT No.: PCT/EP2012/066398
§ 371 (c)(1),
(2), (4) Date: Mar. 21, 2014

(87) PCT Pub. No.: WO2013/034445
PCT Pub. Date: Mar. 14, 2013

(65) Prior Publication Data

US 2014/0210576 A1 Jul. 31, 2014

(30) Foreign Application Priority Data

Sep. 5, 2011 (DE) ..... 10 2011 082 114

(51) Int. Cl.

| | |
|---|---|
| ***H01F 3/00*** | (2006.01) |
| ***H01H 3/28*** | (2006.01) |
| ***H01F 7/16*** | (2006.01) |
| ***H01H 33/666*** | (2006.01) |
| *H01F 7/127* | (2006.01) |

(52) U.S. Cl.
CPC ..... *H01H 3/28* (2013.01); *H01F 7/1615* (2013.01); *H01F 7/1623* (2013.01); *H01H 33/6662* (2013.01); *H01F 7/127* (2013.01)
USPC ..... 335/298; 335/179; 335/229; 335/255

(58) Field of Classification Search
USPC ..... 335/179, 229, 255, 298
See application file for complete search history.

(56) References Cited

U.S. PATENT DOCUMENTS

| | | | |
|---|---|---|---|
| 4,644,311 | A | 2/1987 | Guery et al. |
| 4,855,701 | A | 8/1989 | Yokoyama et al. |
| 7,075,398 | B2 | 7/2006 | Morita et al. |
| 8,013,698 | B2 | 9/2011 | Bonjean et al. |
| 2007/0200653 | A1 | 8/2007 | Matsumoto et al. |
| 2009/0072636 | A1 | 3/2009 | Gruden |

FOREIGN PATENT DOCUMENTS

| | | | |
|---|---|---|---|
| DE | 19637077 | A1 | 3/1998 |
| DE | 102004034296 | B3 | 6/2005 |

(Continued)

*Primary Examiner* — Ramon Barrera
(74) *Attorney, Agent, or Firm* — Laurence A. Greenberg; Werner H. Stemer; Ralph E. Locher

(57) ABSTRACT

An electromagnetic drive for an electrical switch such as a circuit breaker, has at least one movable armature that can implement a lifting movement along a pushing direction for moving a movable switching contact of the switch. In a closed armature position, the armature closes a magnetic circuit through first and second magnetically conductive yoke parts. A permanent magnet produces a magnetic field for the magnetic circuit and a holding force for holding the armature in the closed position. A coil is disposed to generate a magnetic flux in the same or opposite direction as the magnetic flux of the permanent magnet. The electromagnetic drive can be readjusted after installation, where the first and second yoke parts are moved relative to one another by the permanent magnet into the adjusted state, whereupon they are fixed in position.

14 Claims, 5 Drawing Sheets

(56) References Cited
FOREIGN PATENT DOCUMENTS

| | | | |
|---|---|---|---|
| DE | 102007038165 | A1 | 2/2009 |
| EP | 0174239 | A1 | 3/1986 |
| EP | 0321664 | A2 | 6/1989 |
| EP | 1225609 | A2 | 7/2002 |
| EP | 1811536 | A1 | 7/2007 |
| EP | 1826784 | A2 | 8/2007 |
| JP | 6053004 | | 3/1985 |

ELECTROMAGNETIC DRIVE

BACKGROUND OF THE INVENTION

Field of the Invention

The invention relates to an electromagnetic drive for an electrical switch.

A drive of this kind is known by way of example from unexamined patent application EP 0 321 664. This drive has a movable armature which can implement a lifting movement along a predetermined pushing direction and can be connected to a movable switching contact of a switch. The drive also has a permanent magnet which produces a magnetic field and a holding force for holding the armature in a predetermined position. A coil is arranged in such a way that the drive can be actuated and the armature can be moved by a flow of current.

BRIEF SUMMARY OF THE INVENTION

The invention is based on the object of disclosing a drive which enables subsequent adjustment of the components and subsequent correction of manufacturing tolerances.

This object is achieved according to the invention by a switch as claimed. Advantageous embodiments of the inventive switch are disclosed in the dependent claims.

According to the invention an electromagnetic drive is then provided for an electrical switch, in particular an electrical circuit breaker, with at least one movable armature, which can implement a lifting movement along a predetermined pushing direction, can be connected indirectly or directly to a movable switching contact of the switch, and, in a closed position, closes a magnetic; circuit of the drive at a first armature-side stop face with a first magnetically conductive yoke part of the drive and at a second armature-side stop face with a second magnetically conductive yoke part of the drive, at least one permanent magnet, which produces a magnetic field for the magnetic circuit and a holding force for holding the armature in the closed position, and at least one coil, which is arranged in such a way that a magnetic flux can be brought about by a current flow through the coil, which magnetic flux is directed in the same direction as or in opposition to the magnetic flux of the permanent magnet in the magnetic circuit, wherein the electromagnetic drive provides the possibility of a readjustment state after installation by virtue of self-adjustment of the position of the first yoke part and the second yoke part relative to one another being possible as a result of the magnetic force of the permanent magnet, and wherein the yoke parts can be brought into a fixedly installed state, in which the alignment of the yoke parts is fixed independently of the further positioning of the armature.

A fundamental advantage of the inventive drive is that, due to the possibility of subsequent self-adjustment, it may be simply installed even with components produced with relatively high manufacturing tolerances because, following installation, the electromagnetic drive, as a result of the magnetic self-adjustment provided according to the invention, can be readjusted with respect to the arrangement of the first and second yoke parts with very little effort. Readjustment occurs automatically due to the magnetic force of the permanent magnet in such a way that the first and second yoke parts are aligned at an optimum spacing from each other.

The at least one permanent magnet is preferably arranged in such a way that it adjoins at least one of the yoke parts of the drive.

Automatic readjustment is possible particularly easily and therefore advantageously if, in the readjustment state, the magnetic circuit is closed by the armature and at least two yoke parts of the drive can be displaced relative to one another along the pushing direction of the armature, so—driven by the magnetic force of the permanent magnet—the yoke-side stop face of the first yoke part is brought in a self-adjusting manner to a spacing from the yoke-side stop face of the second yoke part which is identical to the spacing between the first and the second armature-side stop face along the predetermined pushing direction.

The at least two yoke parts, which can be displaced relative to one another along the pushing direction of the armature, are screwed together, wherein one screw is led through a hole in one of the two yoke parts and is screwed to the other of the two yoke parts. The diameter of the hole along the pushing direction of the armature is preferably greater than the diameter of the screw. With a loose screw connection and closed position of the armature the yoke parts are in the readjustment state in this arrangement and can be displaced relative to one another along the pushing direction of the armature; with a tight screw connection the yoke parts are, by contrast, in a fixedly installed state.

The diameter of the hole along the pushing direction of the armature is preferably at least 10% greater than the diameter of the screw. The hole can be by way of example a slot whose longitudinal direction is oriented along the pushing direction of the armature.

The yoke parts and the permanent magnet (s) preferably form a magnetically conductive hollow body with an opening slit through which the armature can plunge into the interior of the hollow body.

In the closed position of the armature the first armature-side stop face rests externally on the outer side of the hollow body and the second armature-side stop face rests internally on the inner side of the hollow body.

It is also regarded as advantageous if the hollow body is tubular or channel-shaped and extends along a longitudinal axis which is oriented perpendicularly to the predetermined pushing direction of the armature, and the opening slit extends parallel to the longitudinal axis and the armature closes the opening slit. The hollow body is preferably closed, an least in certain sections, at its leading and trailing tubular or channel end by a metal sheet in each case, preferably made from magnetically non-conductive material.

The armature is preferably a plunger armature with a T-shaped cross-section.

The armature is preferably connected to a spring device which exerts a spring force in the direction of the open position of the armature in which the magnetic circuit is opened.

The invention also relates to a method for installing an electromagnetic drive for an electrical switch, in particular an electrical circuit breaker. According to the invention it is provided in relation to a method of this kind that the drive is pre-installed and the magnetic circuit is then closed by the armature in that the armature is brought into its closed position, the drive is brought into the readjustment state and self-adjustment of the position of the yoke parts relative to one another occurs due to the magnetic force of the permanent magnet, and after self-adjustment the yoke parts are brought into a fixedly installed state in which the alignment of the yoke parts remains fixed independently of the further positioning of the armature.

Reference is made with respect to the advantages of the inventive method to the above statements in connection with the inventive electrical switch since the advantages of the inventive method substantially match those of the electrical switch.

It is regarded as advantageous if, in the readjustment state, at least two yoke parts—driven by the magnetic force of the permanent magnet—are displaced relative to one another along the pushing direction of the armature until the yoke-side stop face of the first yoke part has been brought in a self-adjusting manner to a spacing from the yoke-side stop face of the second yoke part, which spacing is identical to the spacing between the first and second armature-side stop face along the predetermined pushing direction.

According to a particularly preferred embodiment it is provided that the drive is brought into the readjustment state by loosening a screw connection between at least two yoke parts which can be displaced relative to one another, within a predetermined region, along the pushing direction of the armature, and after self-adjustment the yoke parts are screwed tight again.

The invention will be explained in more detail below with reference to exemplary embodiments. In the drawings, by way of example:

BRIEF DESCRIPTION OF THE SEVERAL VIEWS OF THE DRAWING

For the sake of clarity the same reference numerals are always used in the figures for identical or comparable components.

DESCRIPTION OF THE INVENTION

Figure 1:
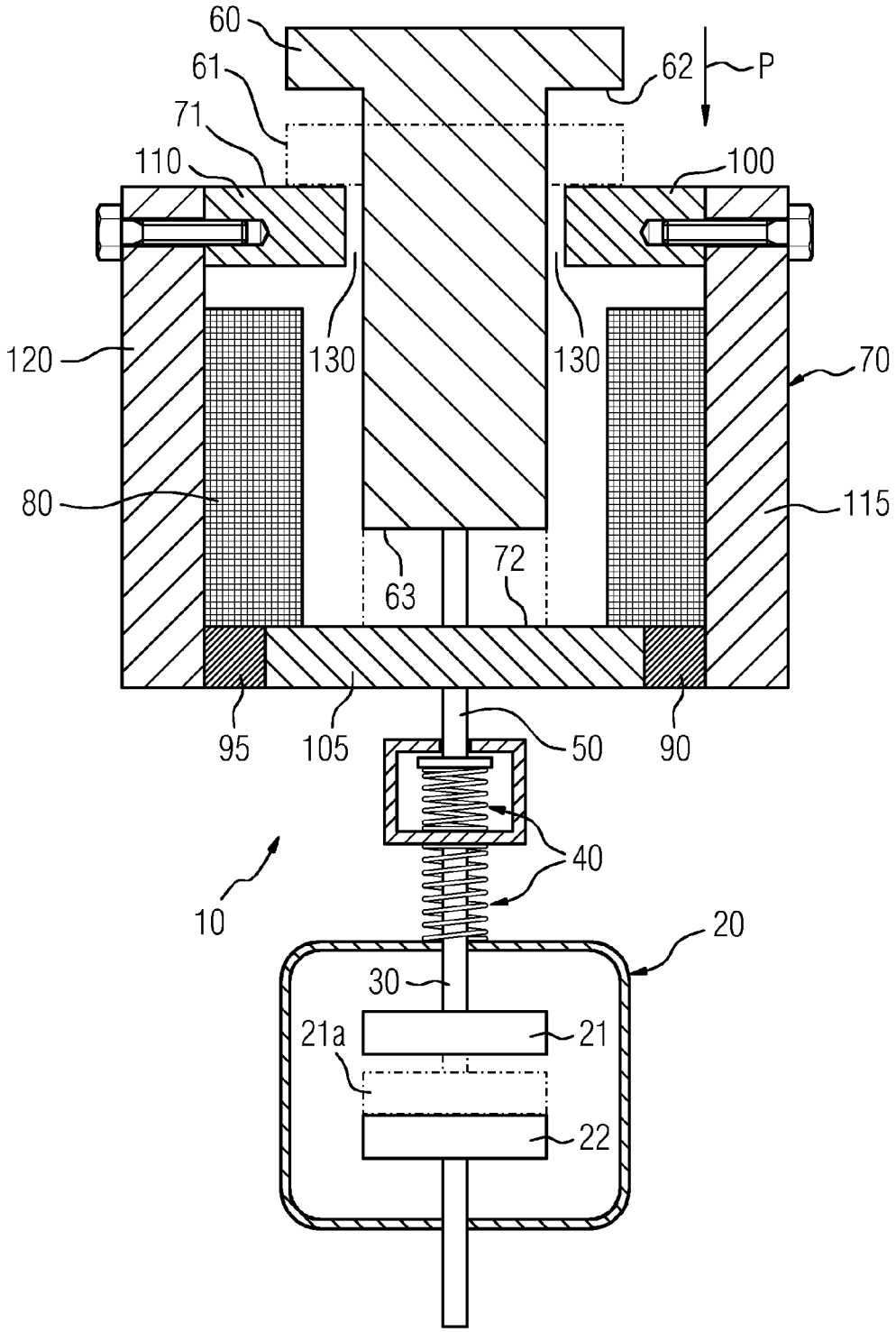
FIG. 1 shows an exemplary embodiment for an arrangement with an electromagnetic drive and an electrical switch which is connected to the electromagnetic drive.

An electromagnetic drive 10 for an electrical switch 20, which can be by way of example a circuit breaker, can be seen in FIG. 1. The electrical switch 20 includes a movable switching contact 21 and a fixed switching contact 22.

The movable switching contact 21 is connected to a drive stem 30 of the electromagnetic drive 10 which cooperates with a spring device 40 of the electromagnetic drive 10. A further drive stem 50 is also coupled to the spring device 40 and this is connected to a plunger armature 60 of the electromagnetic drive 10.

The plunger armature 60 can implement a lifting movement along a predetermined pushing direction P and plunge into a magnetic hollow body 70 of the drive 10 in the process. With solid lines FIG. 1 shows the plunger armature 60 in an open position in which it projects from the hollow body 70. Broken lines and the reference numeral 61 show the closed position of the plunger armature in which it is completely introduced into the magnetic hollow body 70.

The function of the spring device 40 is to press the additional drive stem 50 in FIG. 1 upwards, so the plunger armature 60 is subjected to a spring force which is designed to bring it into the open position. In the open position of the plunger armature 60 the movable switching contact 21 is in an open position which is shown in FIG. 1 by solid lines.

As will be explained in more detail below, by feeding a current through a coil 80 of the electromagnetic drive 10 a magnetic force can be produced with which the plunger armature 60 is brought into its closed position counter to the spring force of the spring device 40. In this closed position the plunger armature is held by the magnetic hollow body 70 even if no current is conducted through the coil 80. The magnetic force, which the magnetic hollow body 70 requires to hold the plunger armature 60 in the closed position, is produced by two permanent magnets 90 and 95 which form components of the magnetic hollow body 70. Apart from the two permanent magnets 90 and 95 the magnetic hollow body 70 in the exemplary embodiment of FIG. 1 includes five yoke parts, namely a first yoke part 100, a second yoke part 105, a third yoke part 110, a fourth yoke part 115 and a fifth yoke part 120. The arrangement of the five yoke parts 100, 105, 110, 115 and 120 is chosen such that the magnetic hollow body 70 forms an opening slit 130 through which the plunger armature 60, which is substantially T-shaped in cross-section, can plunge into the hollow body. The five yoke parts 100, 105, 110, 115 and 120 are made from a magnetizable material, by way of example a material containing iron.

Once the plunger armature 60 has reached its closed position the two drive stems 30 and 50 press the movable switching contact 21 in FIG. 1 downwards, so this also reaches its closed position and closes the electrical switch 20. The movable position of the switching contact 21 is identified in FIG. 1 by broken lines and reference numeral 21*a*.

It may also be seen in FIG. 1 that the plunger armature 60 has a first armature-side stop face 62 and a second armature-side contact face 63. In the closed position of the plunger armature 60 the first armature-side contact face 62 rests on the outer side 71 of the magnetic hollow body 70 and on the outer side of the first yoke part 100 and the third yoke part 110. In the closed position of the plunger armature 60 the second armature-side stop face 63 rests on the inner side 72 of the hollow body 70 and, more precisely, on the inner side of the second yoke part 105.

In the closed position of the plunger armature 60 two magnetic circuits are closed whose magnetic flux is created by the two permanent magnets 90 and 95. The magnetic flux of the first magnetic circuit flows from the permanent magnet 90, via the fourth yoke part 115, the first yoke part 100, the plunger armature 60 and the second yoke part 105 back to the permanent magnet 90. The magnetic flux of the second permanent magnet 95 flows via the fifth yoke part 120, the third yoke part 110, the plunger armature 60 and the second yoke part 105.

The plunger armature 60 is held in its closed position by the magnetic force of the two magnetic circuits, although the spring force of the spring device 40 wants to bring the plunger armature 60 into the open position. The spring force of the spring device 40 is therefore smaller than the magnetic force of the magnetic circuits of the two permanent magnets 90 and 95.

If the electrical switch 20 is to be opened by the electromagnetic drive 10 then a current, which is opposed to the two magnetic circuits of the two permanent magnets 90 and 95, is fed through the coil 80. The magnetic holding force of the two magnetic circuits of the two permanent magnets 90 and 95 is reduced as a result, so the spring force of the spring device 40 is sufficient to press the plunger armature 60 into its open position. In the open position of the plunger armature 60 the spacing between the first armature-side stop face 62 and the outer side 71 of the hollow body and the spacing between the second armature stop face 63 and the inner side 72 of the hollow body is so large that the magnetic force of the permanent magnets 90 and 95 is no longer sufficient to close the plunger armature 60 counter to the spring force of the spring device 40.

Figure 2:
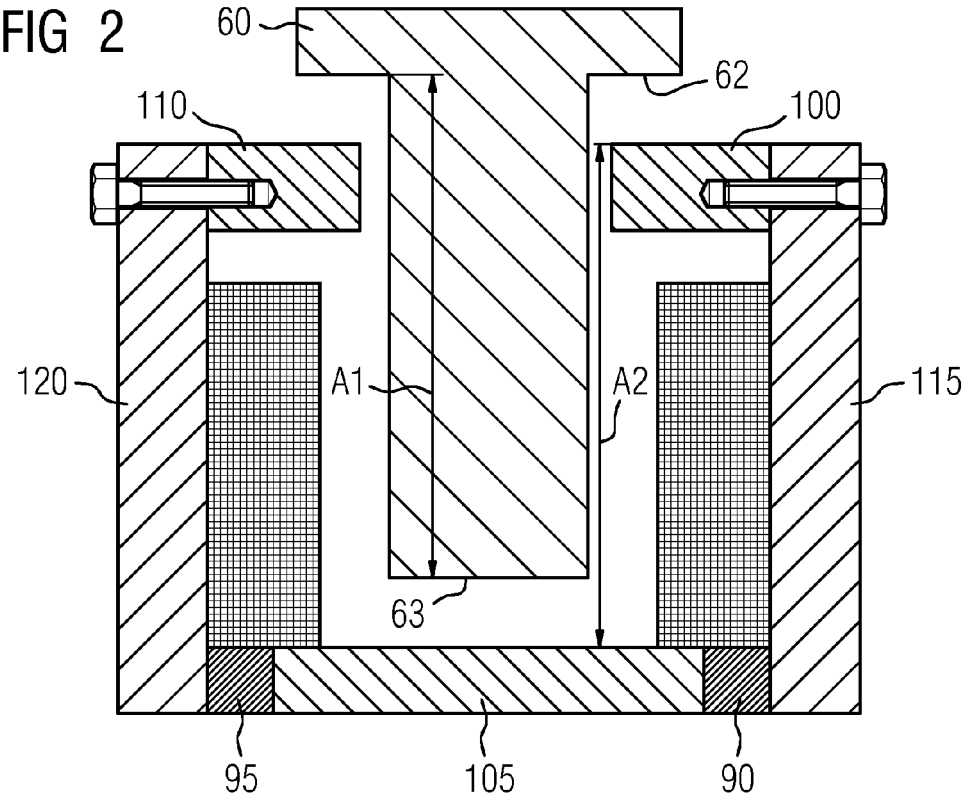
FIG. 2 shows a plunger armature of the electromagnetic drive according to FIG. 1 in an open position and in more detail.
Figure 3:
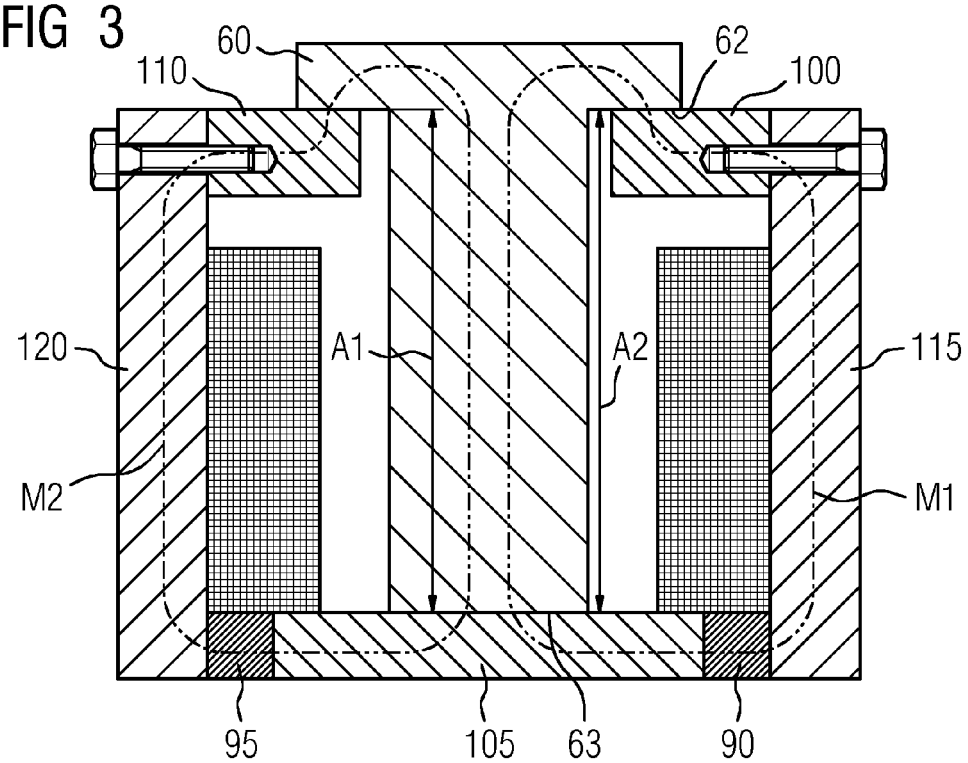
FIG. 3 shows the plunger armature according to FIG. 2 in a closed position.

For an improved overview FIG. 2 shows the plunger armature 60 in a larger diagram in its open position again. It can be seen that the spacing A2 between the first armature-side stop face 62 and the second armature-side stop face 63 matches the spacing A1 between the outer side of the first yoke part 100 and the inner side of the second yoke part 105. For this reason the two magnetic circuits of the two permanent magnets 90 and 95 are closed so as to be gap-free, or at least approximately gap-free, if the plunger armature 60 is introduced fully into the hollow body 70. FIG. 3 shows this in more detail.

It can be seen in FIG. 3 that the first armature-side stop face 62 rests on the outer side of the two yoke parts 100 and 110 and the two magnetic circuits M1 and M2 are closed at this location. In a corresponding manner the two magnetic circuits M1 and M2 are also closed at the second armature-side stop face 63, because this rests completely on the inner side of the second yoke part 105.

The complete closure, shown in FIG. 3, of the two magnetic circuits M1 and M2 is only possible in the case of the electromagnetic drive 10 according to FIGS. 1 to 3 because the spacing A1 between the two armature-side stop faces 62 and 63 is identical to the spacing A2 between the outer side of the two yoke parts 100 and 110 and the inner side of the second yoke part 105.

There is preferably a readjustment option in the exemplary embodiment according to FIGS. 1 to 3, with which the position of the yoke parts can subsequently be automatically relatively readjusted. The mode of operation of a readjustment option of this kind will be explained below by way of example with reference to exemplary embodiments in which the length of the plunger armature 60 is not optimum.

Figure 4:
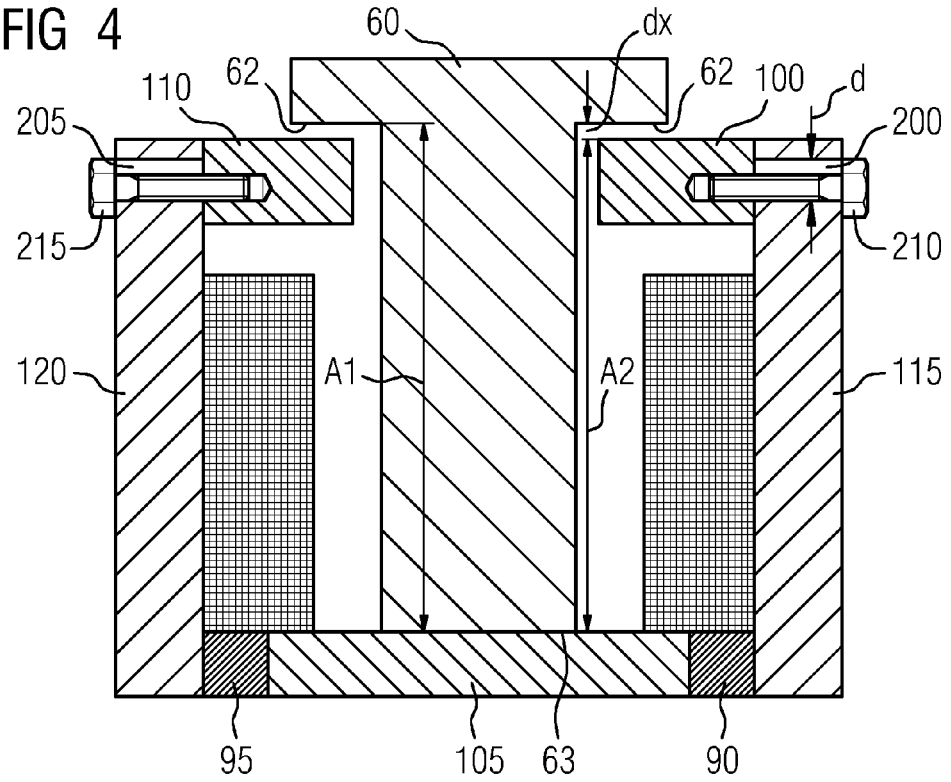
FIG. 4 shows a second exemplary embodiment for an electromagnetic drive in which the plunger armature is slightly too large for the hollow body into which it should plunge.

FIG. 4 shows a case in which the spacing A1 between the two armature-side stop faces 62 and 63 is slightly larger than the spacing A2. As may be seen:

$$A1=A2+\mathrm{dx}\text{ here.}$$

The difference in length dx can be based on manufacturing tolerances in the production of the yoke parts, in particular the fourth yoke part 115 and the fifth yoke part 120, or on manufacturing tolerances in the production of the plunger armature 60.

To nevertheless ensure that, in its closed position, the plunger armature 60 can close the two magnetic circuits M1 and M2 (cf. FIG. 3) without air gaps having to be bridged, in the exemplary embodiment according to FIG. 4 a readjustment option is provided in the fourth yoke part 115 and in the fifth yoke part 120 with which the manufacturing tolerances can be subsequently corrected.

Figure 5:
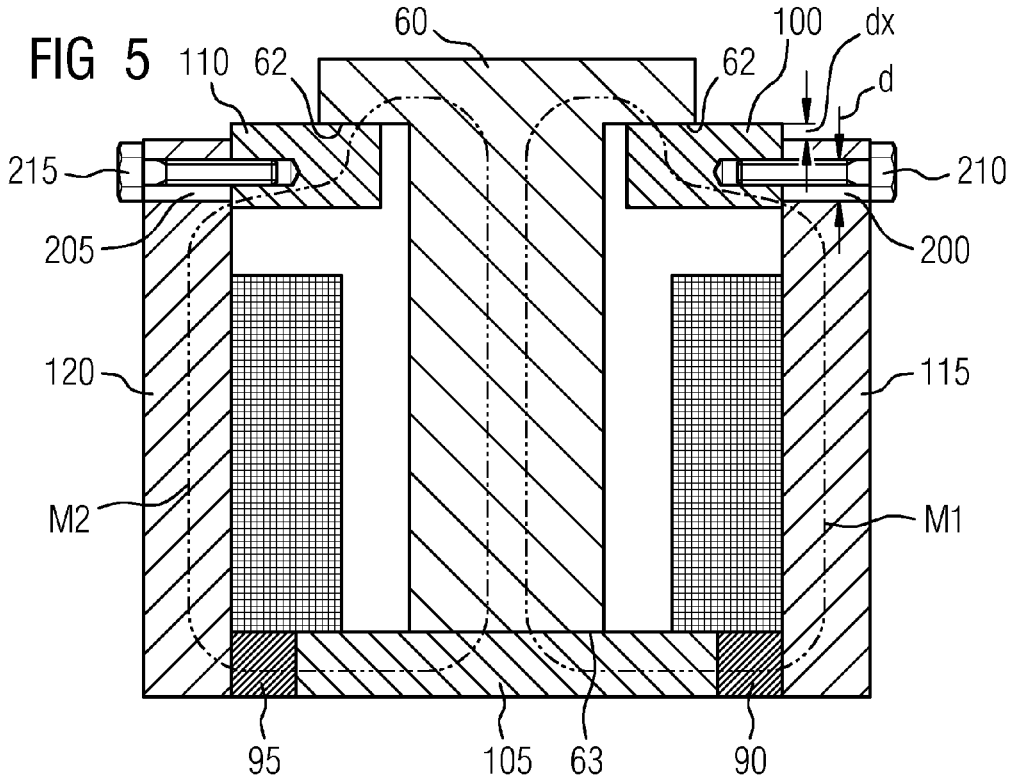
FIG. 5 shows the plunger armature according to FIG. 4 after a readjustment of the drive.

It can be seen in FIG. 4 that the fourth yoke part 115 and the fifth yoke part 120 are each fitted with holes 200 and 205 whose diameter d is slightly greater than the diameter of the associated fastening screws 210 and 215 which are screwed into the first yoke part 100 and the third yoke part 110 and fixedly hold the fourth yoke part 115 and the fifth yoke part 120. Due to the over-dimensioned size of the holes 200 and 205 it is accordingly possible to subsequently correct the difference in length dx by loosening the two fastening screws 210 and 215 in the closed position of the plunger armature 60. Due to the magnetic force of the two permanent magnets 90 and 95 the first yoke part 100 and the third yoke part 110 are pulled upwards, so they abut with their outer side on the first armature-side stop face 62. FIG. 5 shows this by way of example. Pulling-up of the first yoke part 100 and the third yoke part 110 is based on the magnetic force of the two magnetic circuits M1 and M2 which always exert a magnetic force such that the magnetic circuit M1 or M2 is closed so as to be gap-free. The air gap, shown in FIG. 4, between the plunger armature 62 and the two yoke parts 105 and 110 is therefore closed by the magnetic force of the two permanent magnets 90 and 95 by the two yoke parts being pulled upwards by the difference in length dx.

The diameter d of the holes 200 and 205 along the pushing direction of the armature is preferably at least 10% greater than the diameter of the fastening screws 210 and 215. The holes 200 and 205 can be slots by way of example whose longitudinal direction is oriented along the pushing direction of the armature.

Once this self-adjustment, which is based on the magnetic force of the permanent magnets 90 and 95, is complete the two fastening screws 210 and 215 can be tightened again, so the position of the first yoke part 100 and that of the third yoke part 110 relative to the fourth yoke part 115 and the fifth yoke part 120 is fixed again by clamping. After fixing the spacing between the two armature-side stop faces 62 and 63 matches the spacing between the outer side of the two yoke parts 100 and 110 and the inner side of the second yoke part 105.

Figure 6:
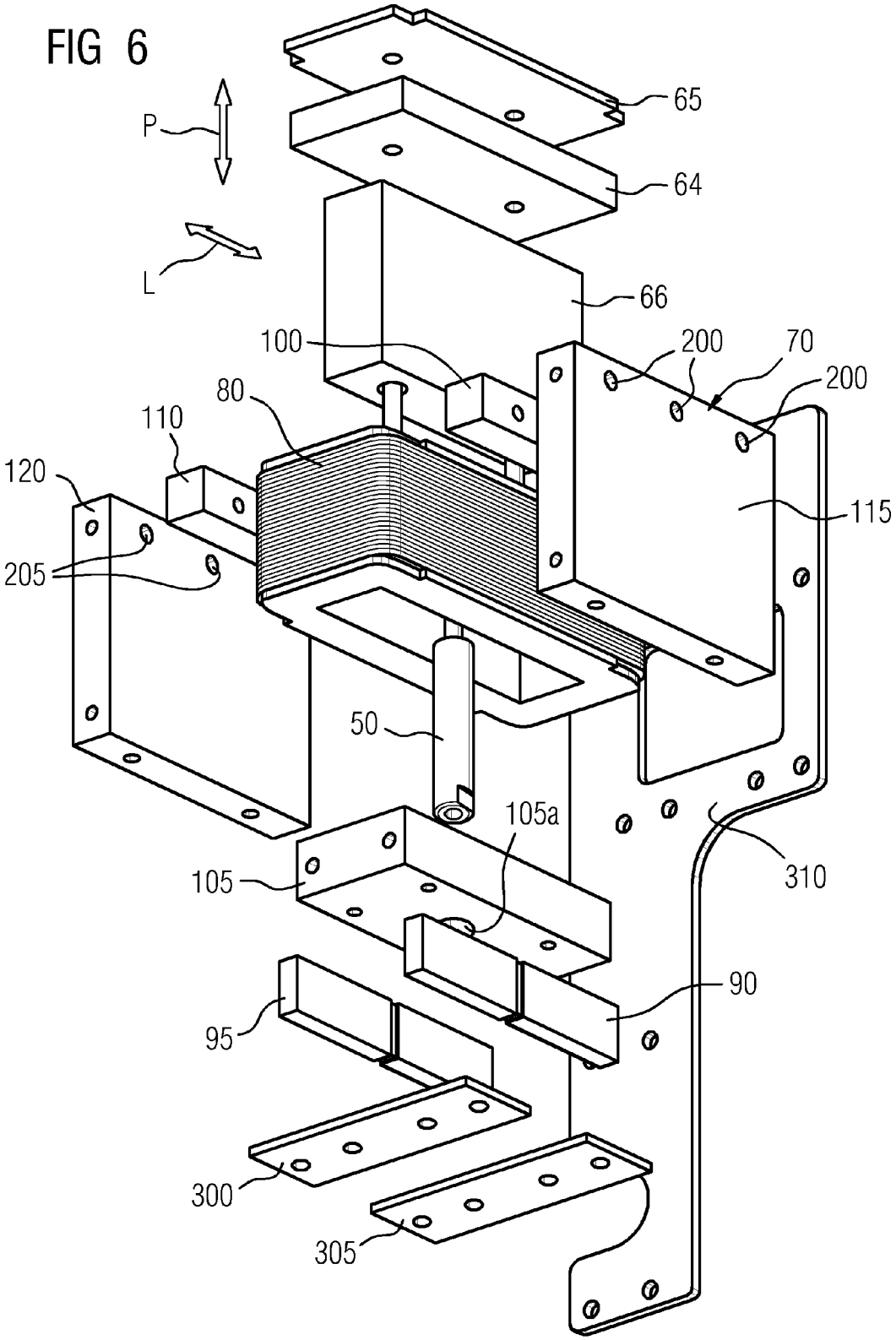
FIG. 6 shows an exemplary embodiment for an inventive electromagnetic drive in a three-dimensional exploded drawing and FIG. 7 shows the electromagnetic drive according to FIG. 6 in the installed state.

FIG. 6 shows by way of example the mechanical construction of an electromagnetic drive in a three-dimensional exploded view. The first yoke part 100 can be seen, and this is screwed to the fourth yoke part 115 by means of screws which are led through over-dimensioned holes 200. Located between the fourth yoke part 115 and the second yoke part 105 is the permanent magnet 90 which is fixed with the aid of two fastening plates 300 and 305 to the yoke parts. The two fastening plates 300 and 305 also fix the other permanent magnet 95 which is positioned between the second yoke part 105 and the fifth yoke part 120. The third yoke part 110 is fixed to the firth yoke part 120 by means of fastening screws which are led through over-dimensioned holes 205.

As already explained, the holes 200 and 205 are slightly larger than the fastening screws used, so automatic self-adjustment can occur if the plunger armature 60 is too large or too small and undesirable air gaps occur in the closed position of the plunger armature. In the exemplary embodiment according to FIG. 6 the plunger armature 60 is formed by an upper armature plate 64 and a guide plate 65 which are screwed to an armature center piece 66.

The additional drive stem 50, which is guided through a hole 105*a* in the second yoke part 105 can also be seen in FIG. 6.

It may also be seen in the diagram according to FIG. 6 that the yoke parts 100, 105, 110, 115 and 120 and the two permanent magnets 90 and 95 form a hollow body which is tubular or channel-shaped and extends along a longitudinal axis L. The longitudinal axis L is perpendicular to the predetermined pushing direction P with which the plunger armature 60 implements its lifting movement. The leading and trailing tube or channel end of the tubular or channel-shaped hollow body is closed by a metal sheet in each case, of which one is shown by way of example in FIG. 6 and is identified by reference numeral 310.

Figure 7:
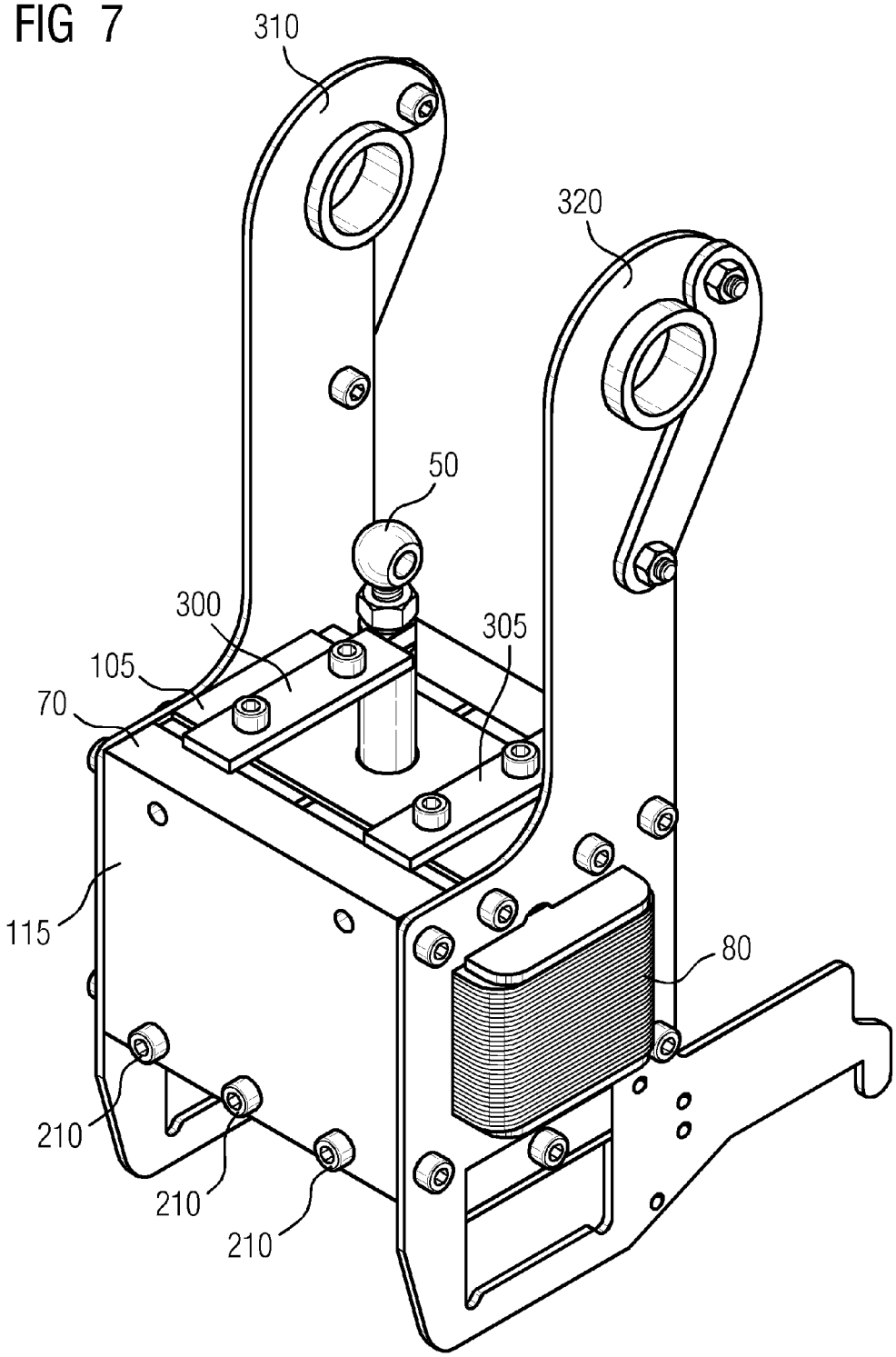

FIG. 7 shows the electromagnetic drive according to FIG. 6 in the installed state. Two metal sheets 310 and 320 can be seen which complete the tubular or channel-shaped hollow body 70 at the two tube or channel ends. The additional drive stem 50 can also be seen, and this is lead out of the hollow body 70 and can be connected to the spring device 40 according to FIG. 1.

The fourth yoke part 115 and the second yoke part 105, the two fastening plates 300 and 305 and the coil 80 can also be seen, and this can project out of the hollow body 70 through recesses in the two metal sheets 310 and 320. The fastening screws 210, with which the first yoke part is screwed to the fourth yoke part 115 in such a way that automatic readjustment, as has been described above, is possible, can also be seen.

Although the invention has been illustrated and described in more detail by preferred exemplary embodiments it is not restricted by the disclosed examples and a person skilled in the art can derive other variations therefrom without departing from the scope of the invention.

List of Reference Numerals

10 electromagnetic drive
20 electrical switch
21 movable switching contact
21*a* movable position
22 fixed switching contact
30 drive stem
40 spring device
50 drive stem
60 plunger armature
61 closed position of the plunger armature
62 first armature-side stop face
63 second armature-side stop face
64 armature plate
65 guide plate
66 armature center piece
70 hollow body
71 outer side
72 inner side
80 coil
90 permanent magnet
95 permanent magnet
100 first yoke part
105 second yoke part
105*a* hole
110 third yoke part
115 fourth yoke part
120 fifth yoke part
130 opening slit
200 hole
205 hole
210 fastening screw
215 fastening screw
300 fastening plate
305 fastening plate
310 metal sheet
320 metal sheet
A1 spacing
A2 spacing
d diameter
dx difference in length
L longitudinal axis
M1 magnetic circuit
M2 magnetic circuit
P pushing direction

The invention claimed is:

1. An electromagnetic drive for an electrical switch with a movable switching contact, the electromagnetic drive comprising:

a movable armature to be connected to the movable switching contact of the switch and disposed to implement a lifting movement along a predetermined pushing direction and to assume a closed position, said movable armature having a first armature-side stop face and a second armature-side stop face;

a yoke having a first magnetically conductive yoke part and a second magnetically conductive yoke part;

said armature, in the closed position, closing a magnetic circuit of the drive at said first armature-side stop face with said first magnetically conductive yoke part and at said second armature-side stop face with said second magnetically conductive yoke part;

at least one permanent magnet for producing a magnetic field for the magnetic circuit and for generating a holding force for holding said armature in the closed position; and a coil disposed to generate a magnetic flux brought about by a current flow through said coil, the magnetic flux being directed in the same direction as or in opposition to the magnetic flux of said permanent magnet in the magnetic circuit;

wherein, after an installation of the electromagnetic drive, a readjustment state is provided by virtue of a self-adjustment of a position of said first and second yoke parts relative to one another due to a magnetic force of the permanent magnet; and wherein said first and second yoke parts are mountable into a fixed, installed state in which an alignment and relative position of said first and second yoke parts is fixed independently of a further positioning of said armature.

2. The electromagnetic drive according to claim 1, wherein, in the readjustment state, the magnetic circuit is closed by said armature and said first and second yoke parts are displaceable relative to one another along the pushing direction of the armature, and, driven by the magnetic force of said permanent magnet, a yoke-side stop face of said first yoke part is self-adjusted to a spacing from a yoke-side stop face of said second yoke part that is identical to a spacing between said first and second armature-side stop faces along the pushing direction.

3. The electromagnetic drive according to claim 2, wherein:

said first and second yoke parts are bolted to one another, with one screw extending through a hole formed in one of said yoke parts and screwed to the other of said yoke parts, wherein a diameter of said hole along the pushing direction of said armature is greater than a diameter of said screw;

said first and second yoke parts are in the readjustment state when a screw connection is loose and said armature is in the closed position; and said yoke parts are in the fixedly installed state when the screw connection is tied down.

4. The electromagnetic drive according to claim 1, wherein said yoke parts and said permanent magnet form a magnetically conductive hollow body with an opening slit and said armature is disposed to plunge into an interior of the hollow body through said opening slit.

5. The electromagnetic drive according to claim 4, wherein, in the closed position of said armature, said first armature-side stop face rests externally on an outer face of said hollow body and said second armature-side stop face rests inwardly on an inner face of said hollow body.

6. The electromagnetic drive according to claim 4, wherein:

said hollow body is tubular or channel-shaped and extends along a longitudinal axis oriented perpendicularly to the predetermined pushing direction of said armature;

said hollow body is closed at a leading and trailing tubular or channel end, at least in certain sections, by a metal sheet;

said opening slit extends parallel to the longitudinal axis; and said armature is configured to close said opening slit.

7. The electromagnetic drive according to claim 1, said armature is a plunger armature with a T-shaped cross-section.

8. The electromagnetic drive according to claim 1, which comprises a spring device disposed to exert on said armature a spring force in a direction forcing said armature into an open position, in which the magnetic circuit is opened.

9. The electromagnetic drive according to claim 1, connected to a switch contact of an electrical circuit breaker.

10. A method for installing an electromagnetic drive for an electrical switch, the method comprising:

providing an electromagnetic drive according to claim 1;

pre-installing the electromagnetic drive and subsequently closing the magnetic circuit with the armature by moving the armature into the closed position;

causing the drive to assume a readjustment state wherein a self-adjustment of a position of the first and second yoke parts relative to one another is forced by a magnetic force of the permanent magnet; and following a self-adjustment of the yoke parts, fixing the yoke parts in position in a fixedly installed state in which an alignment of the yoke parts remains fixed independently of a further positioning of the armature.

11. The method according to claim 10, which comprises, in the readjustment state, displacing said at least two yoke parts by the magnetic force of the permanent magnet relative to one another along a pushing direction of the armature until a yoke-side stop face of the first yoke part has been brought in a self-adjusting manner to a spacing from the yoke-side stop face of the second yoke part, wherein the spacing is identical to a spacing between the first and second armature-side stop face along the predetermined pushing direction.

12. The method according to claim 10, which comprises:

bringing the drive into the readjustment state by loosening a screw connection between at least two yoke parts to enable a displacement of the yoke parts relative to one another, within a predetermined range, along the pushing direction of the armature; and following the self-adjustment, screwing the yoke parts tightly to one another.

13. A method for installing an electromagnetic drive for an electrical switch, the method comprising:

pre-installing the electromagnetic drive and subsequently closing a magnetic circuit with an armature by moving the armature into a closed position thereof;

causing the drive to assume a readjustment state wherein a self-adjustment of a position of yoke parts of a yoke of the electromagnetic drive relative to one another occurs due to a magnetic force of a permanent magnet; and following a self-adjustment of the yoke parts, fixing the yoke parts in position in a fixedly installed state in which an alignment of the yoke parts remains fixed independently of a further positioning of the armature.

14. The method according to claim 13, wherein the electrical switch is an electrical circuit breaker.

* * * * *